US006116524A

United States Patent [19]

Zapalac

[11] Patent Number: 6,116,524

[45] Date of Patent: Sep. 12, 2000

[54] BRUSH AND WATER SPRAY SYSTEM

[76] Inventor: Thelma Janette Zapalac, Providence - Rte. 5, Box 162, Livingston, Tex. 77351

[21] Appl. No.: 09/209,608

[22] Filed: Dec. 11, 1998

[51] Int. Cl.[7] ..... A62C 2/08

[52] U.S. Cl. ..... 239/548; 239/390; 239/397; 239/436; 239/437; 239/540; 239/552; 239/587.1; 239/587.4; 4/615; 401/28

[58] Field of Search ..... 239/289, 390, 239/391, 392, 394, 397, 436, 437, 442, 443, 446, 537, 538, 540, 547, 548, 552, 556, 558, 587.1, 587.4, 588; 4/606, 615; 401/28; 15/24, 29

[56] References Cited

U.S. PATENT DOCUMENTS

| | | | |
|---|---|---|---|
| 757,791 | 4/1904 | Van't Woud | 401/28 |
| 816,924 | 4/1906 | Lattin | 401/28 |
| 969,292 | 9/1910 | Lawler | 401/28 |
| 1,512,581 | 10/1924 | Deming | 4/615 X |
| 1,597,477 | 8/1926 | Panhorst | 239/548 |
| 1,696,835 | 12/1928 | Burnett | 15/29 |
| 1,840,812 | 1/1932 | Hardy | 4/615 X |
| 2,116,864 | 5/1938 | Fehrenbach | 239/556 X |
| 2,480,023 | 8/1949 | Holden | 401/28 |
| 2,743,848 | 5/1956 | Estes et al. | 222/466 X |
| 2,893,644 | 7/1959 | Holden | 239/289 X |
| 3,358,934 | 12/1967 | Moen | 239/443 |
| 3,432,105 | 3/1969 | Delmater | 239/540 X |
| 4,880,165 | 11/1989 | Fuquay | 239/525 |

*Primary Examiner*—Andres Kashnikow
*Assistant Examiner*—Robin O. Evans

[57] ABSTRACT

A brush and water spray system comprising, a primary head having a flat exterior section with apertures therethrough for dispensing water, a tubular interior section in a cylindrical configuration adapted to be coupled to a shower outlet tube for receiving water to be dispensed and a generally hemispherical intermediate section with a housing therewithin and a connector at the interiormost end of the inner section couplable to the shower outlet tube.

17 Claims, 5 Drawing Sheets

BRUSH AND WATER SPRAY SYSTEM

BACKGROUND OF THE INVENTION

1. Field of the Invention

The present invention relates to a brush and water spray system and more particularly pertains to spraying and brushing a person in the shower.

2. Description of the Prior Art

The use of spray heads and brushes of various designs and configurations is known in the prior art. More specifically, spray heads and brushes of various designs and configurations heretofore devised and utilized for the purpose of washing in the shower through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,678,457 to Demo et al. discloses a Scrubbing Brush Operated By Water Power. U.S. Pat. No. 1,840,812 to Hardy discloses a Combination Shower Bath Spray, Bath Sponge and Massage Device. U.S. Pat. No. 4,155,137 discloses a Hydraulic Powered Turbine Brush in a Hydraulic Line. U.S. Pat. No. 5,678,258 to Healy discloses a Multiple Showerhead Apparatus. U.S. Pat. No. 3,431,573 to Frandsen discloses a Pressurized-Water-Operated Cleaning Apparatus. Lastly, U.S. Pat. No. 4,089,079 to Nicholson discloses a Rotary Washing Brush Device.

In this respect, the brush and water spray system according to the present invention substantially departs from the conventional concepts and designs of the prior art, and in doing so provides an apparatus primarily developed for the purpose of spraying and brushing a person in the shower.

Therefore, it can be appreciated that there exists a continuing need for a new and improved brush and water spray system which can be used for spraying and brushing a person in the shower. In this regard, the present invention substantially fulfills this need.

SUMMARY OF THE INVENTION

In view of the foregoing disadvantages inherent in the known types of spray heads and brushes of various designs and configurations now present in the prior art, the present invention provides an improved brush and water spray system. As such, the general purpose of the present invention, which will be described subsequently in greater detail, is to provide a new and improved brush and water spray system and method which has all the advantages of the prior art and none of the disadvantages.

To attain this, the present invention essentially comprises a new and improved brush and water spray system for spraying and brushing a person in the shower. The system includes a primary head which has a flat exterior section with apertures therethrough for dispensing water. The system also includes a tubular interior section which is in a cylindrical configuration and is adapted to be coupled to a shower outlet tube for receiving water to be dispensed and a generally hemispherical intermediate section with a housing therewithin. Also provided is a connector at the interiormost end of the interior section which includes a hemispherical male component coupled to the interior face and a rotatable cylinder with a hemispherical female surface adapted to receive the male component and with internal threads couplable to the shower outlet tube. Also provided is a pair of primary straps having exterior ends attached to the intermediate section of the primary head, a pair of secondary straps having interior ends attached to the intermediate section of the primary head with sleeves between the primary and secondary straps to vary the axial spacing between the exterior section and the interior section. Lastly provided is a plurality of adapters in a circular configuration with circumferential fingers for the selective removable coupling of the adapters with respect to the exterior section of the primary head. Each adapter has outwardly extending fingers of a preselected length with apertures between the fingers for the dispensing of water during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved brush and water spray system which has all of the advantages of the prior art spray heads and brushes of various designs and configurations and none of the disadvantages.

It is another object of the present invention to provide a new and improved brush and water spray system which may be easily and efficiently manufactured and marketed.

It is further object of the present invention to provide a new and improved brush and water spray system which is of durable and reliable constructions.

An even further object of the present invention is to provide a new and improved brush and water spray system which is susceptible of a low cost of manufacture with regard to both materials and labor, and which accordingly is then susceptible of low prices of sale to the consuming public, thereby making such a brush and water spray system economically available to the buying public.

Even still another object of the present invention is to provide a brush and water spray system for spraying and brushing a person in the shower.

Lastly, it is an object of the present invention to provide a new and improved brush and water spray system comprising a primary head having a flat exterior section with apertures therethrough for dispensing water, a tubular interior section in a cylindrical configuration adapted to be coupled to a shower outlet tube for receiving water to be dispensed and a generally hemispherical intermediate section with a housing therewithin and a connector at the interiormost end of the inner section couplable to the shower outlet tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
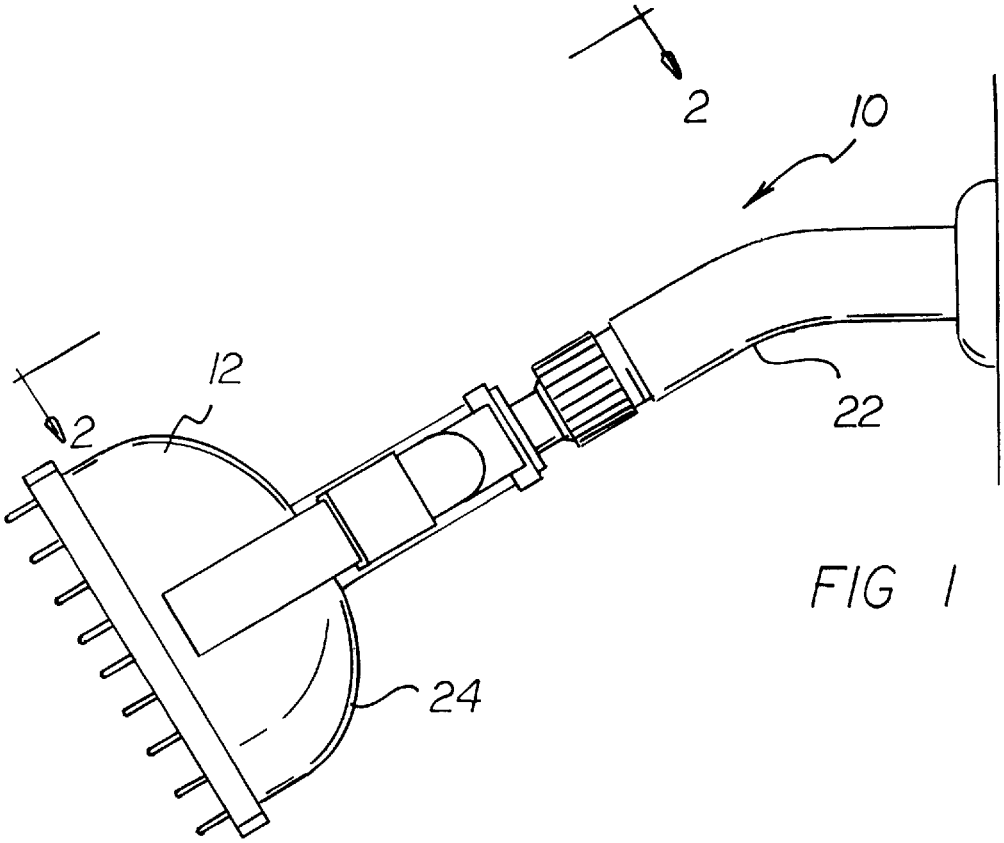
FIG. 1 is a side elevational view of the preferred embodiment of the brush and water spray system constructed in accordance with the principles of the present invention.
Figure 2:
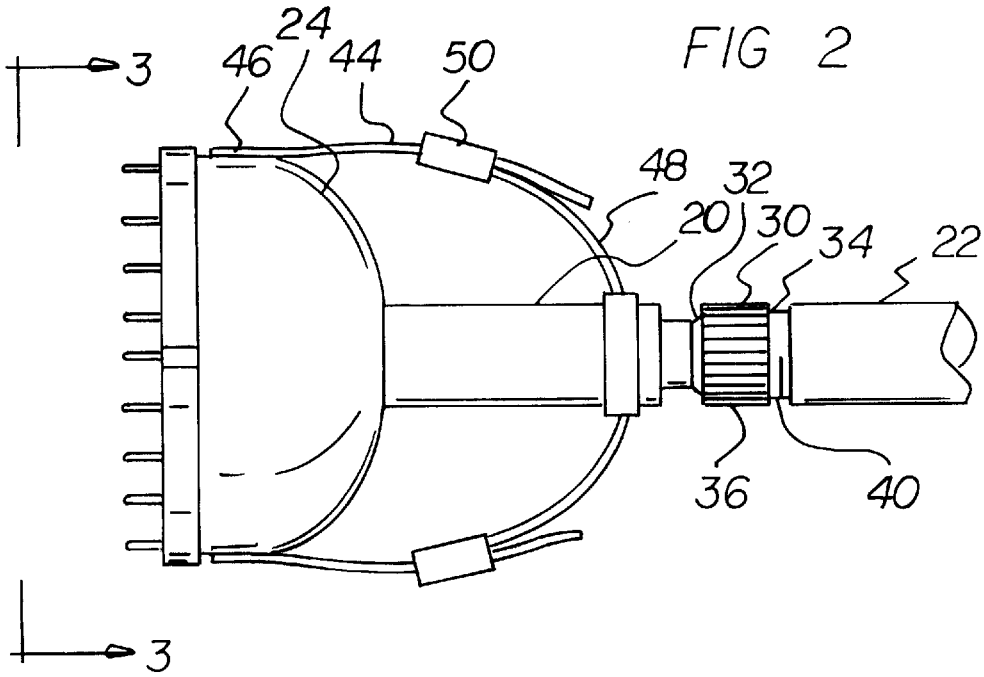
FIG. 2 is a top elevational view of the device shown in FIG. 1 taken along line 2—2 of FIG. 1.
Figure 3:
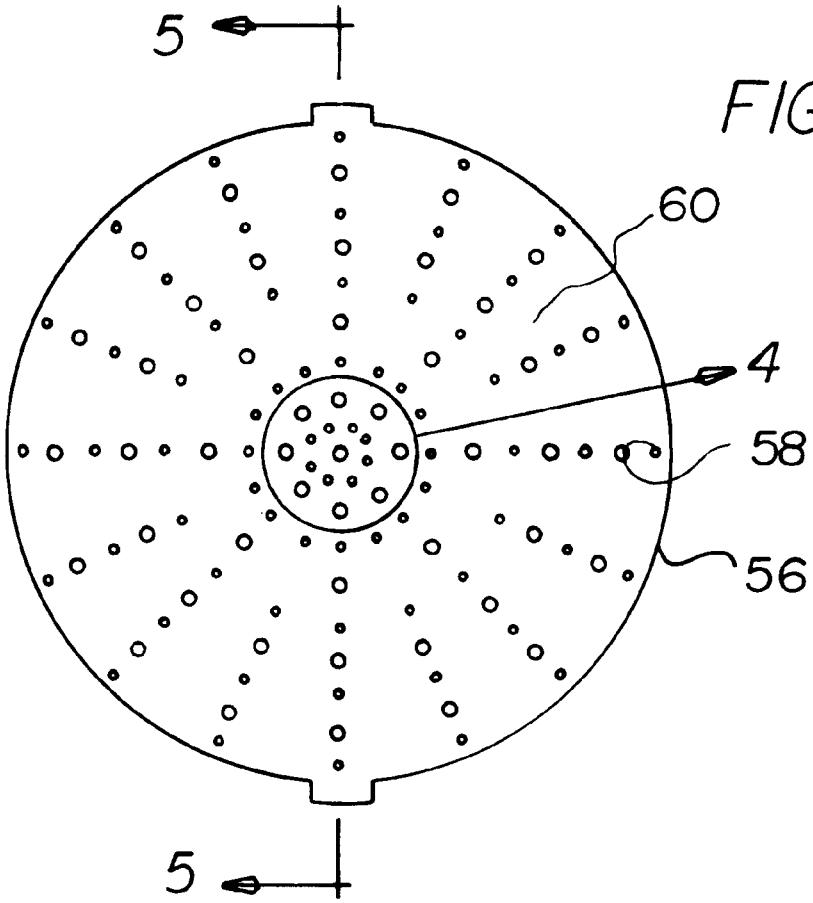
FIG. 3 is a front elevational view of the device shown in the prior Figures taken along line 3—3 of FIG. 2.
Figure 4:
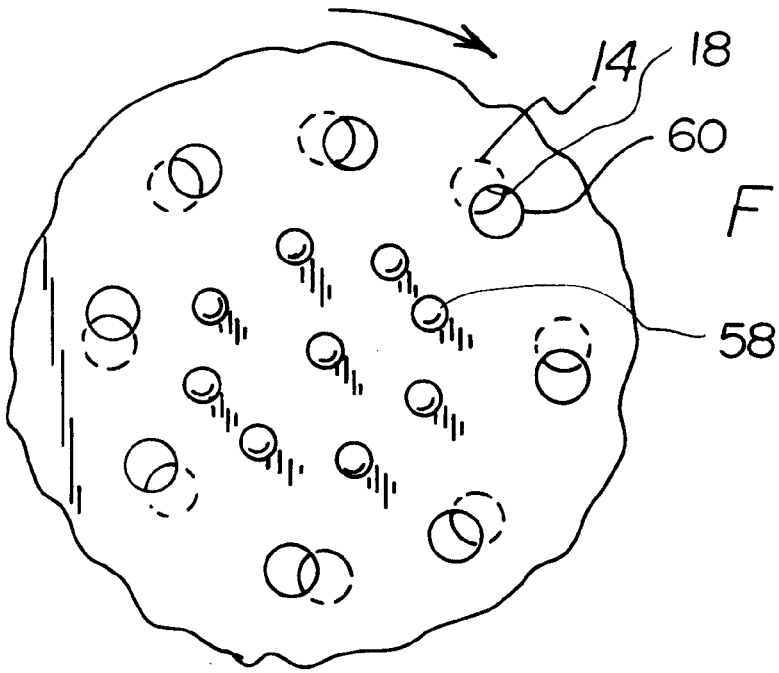
FIG. 4 is a partial view similar to FIG. 3 but illustrating the primary head rotated slightly to vary the output of the water taken at circle 4 of FIG. 3.
Figure 5:
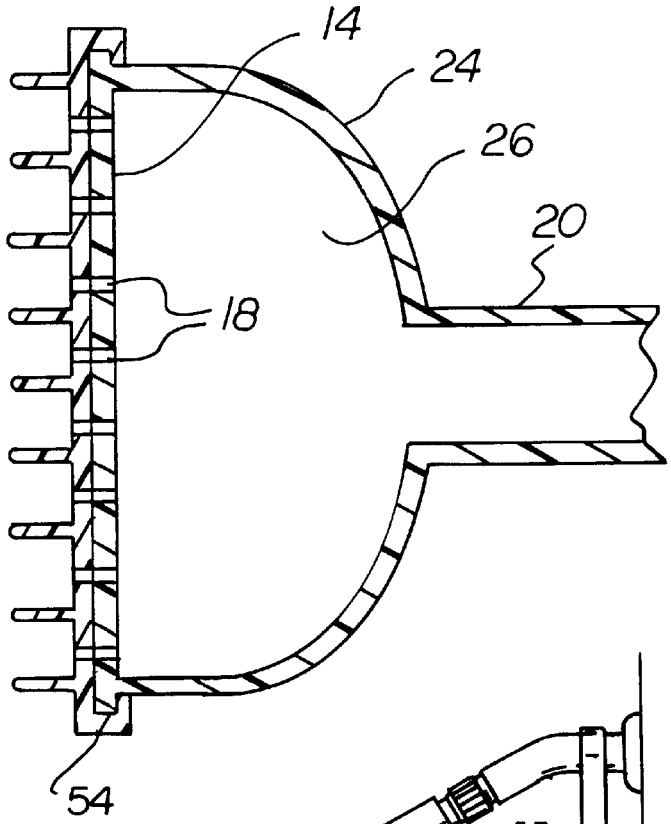
FIG. 5 is a cross-sectional view taken along line 5—5 of FIG. 3.
Figure 6:
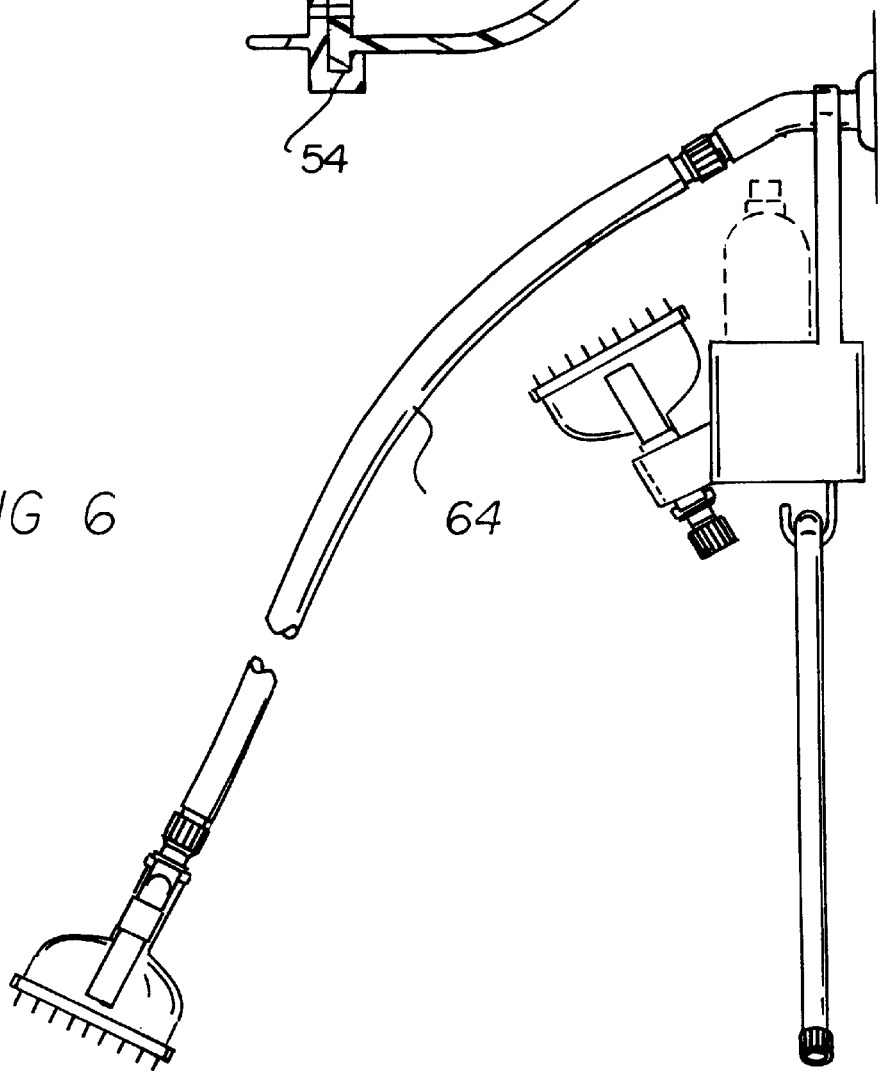
FIG. 6 is a perspective view similar to FIG. 1 but showing an alternate embodiment of the invention.
Figure 7:
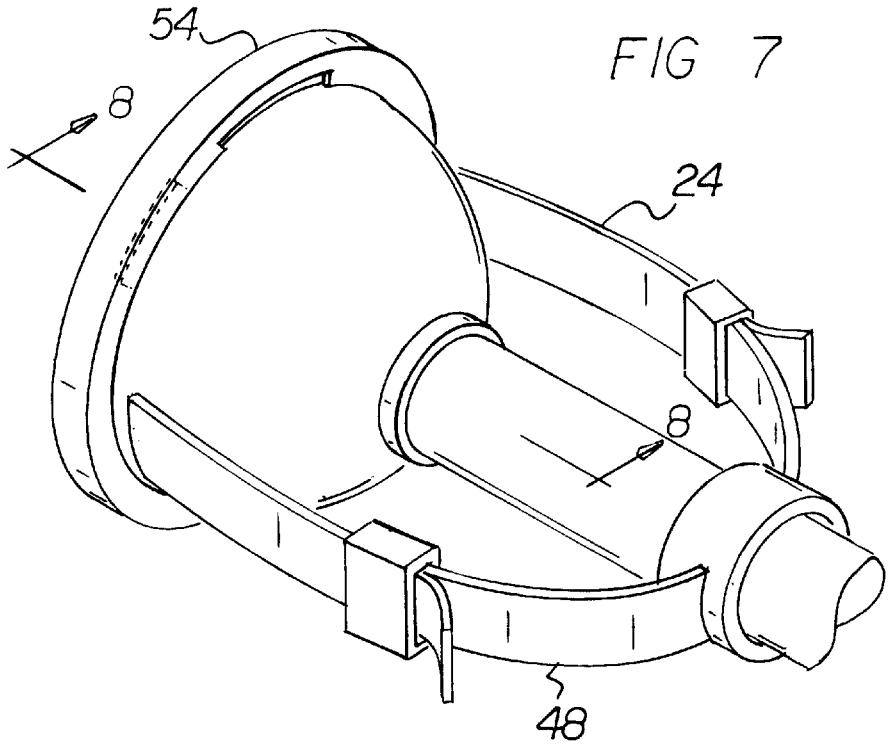
FIG. 7 is a perspective view of the head shown in FIG. 6 but with rotational capabilities afforded by the primary head.
Figure 8:
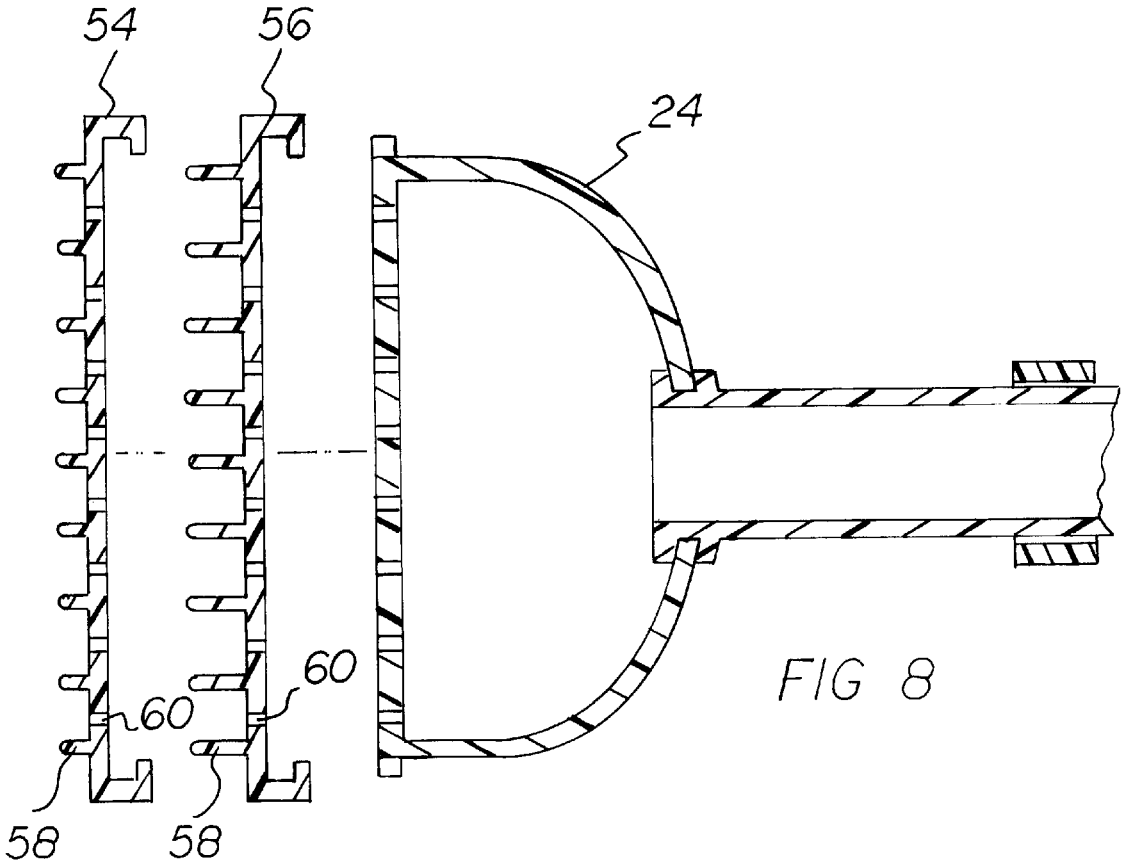
FIG. 8 is a cross-sectional view taken along line 8—8 of FIG. 7 illustrating alternate adapters.

With reference now to the drawings, and in particular to FIG. 1 thereof, the preferred embodiment of the new and improved brush and water spray system embodying the principles and concepts of the present invention and generally designated by the reference numeral 10 will be described.

The present invention, the brush and water spray system 10 is comprised of a plurality of components. Such components in their broadest context include a primary head, a connector, a pair of primary straps, and a plurality of adapters. Such components are individually configured and correlated with respect to each other so as to attain the desired objective.

More specifically, the new and improved brush and water spray system 10 for spraying and brushing a person in the shower comprises in combination a primary head 12 having a flat exterior section 14 with apertures 18 therethrough for dispensing water. Also provided is a tubular interior section 20 in a cylindrical configuration adapted to be coupled to a shower outlet tube 22 for receiving water to be dispensed. Also provided is a generally hemispherical intermediate section 24 with a housing 26 therewithin.

Also included is a connector 30 at the interiormost end of the interior section including a hemispherical male component 32 coupled to the interior face 34 and a rotatable cylinder 36. Also provided is a hemispherical female surface adapted to receive the male component and with internal threads 40 couplable to the shower outlet tube.

Further provided is a pair of primary straps 44 having exterior ends 46 attached to the intermediate section of the primary head. A pair of secondary straps 48 having interior ends is provided and attached to the intermediate section of the primary head with sleeves 50 between the primary and secondary straps to vary the axial spacing between the exterior section and the interior section such that fingers of a user may be inserted between the straps and the interior section to control the direction of the primary head.

Lastly provided is a plurality of adapters 54, 56 in a circular configuration with fingers 58, in a circumferenetial arrangement, for the selective removable coupling of the adapters with respect to the exterior section of the primary head. Each adapter has outwardly extending fingers of a preselected length with apertures 60 between the fingers 58 for the dispensing of water during operation and use.

The flexible hose has a pair of opposite ends and a length defined between the ends of the flexible hose. The length of the flexible hose is between about 30 inches and about 36 inches. The adapter has a diameter such that a length of the primary head is defined generally perpendicular to the flat exterior section less than the diameter of the adapter. The length of the primary head is about 2 inches.

As shown in an alternate embodiment, a flexible tube or hose 64 is included and is couplable between the shower outlet tube and the interior section.

As also shown in an alternate embodiment, the coupling between the central section and the innermost section is rotatable.

Figure 9:
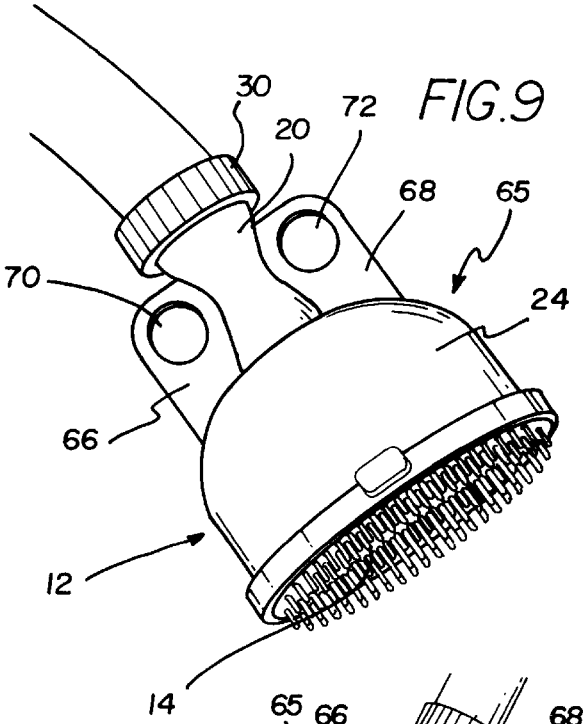
FIG. 9 is a side view illustrating a preferred embodiment of the present invention having a pair of fins with finger holes.
Figure 11:
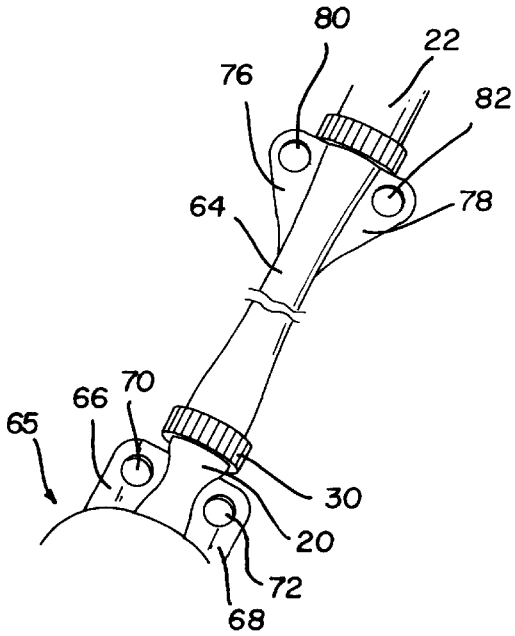
FIG. 11 is a partial side view of the preferred embodiment of FIGS. 9 and 10 with an length of flexible hose connecting the head to the shower faucet.
Figure 10:
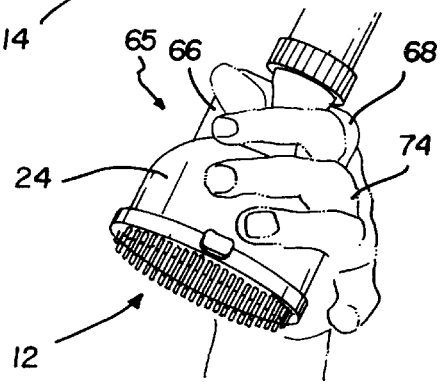
FIG. 10 is a perspective view of the preferred embodiment of FIG. 9 illustrating a method of grasping the head with the hand of a user.

FIGS. 9 through 11 illustrated an additional preferred embodiment 65 of the present invention. In this preferred embodiment 65, a pair of generally rectangular and generally planar primary fins 66,68 are outwardly extended from the intermediate section 24 of the primary head in a direction extending from the intermediate section 24 towards the interior section 20 of the primary head. The interior section 20 of the primary head is interposed between the primary fins 66,68. The primary fins preferably generally lie in a common plane with one another extending generally parallel to a longitudinal axis along the interior section of the primary head 12 generally perpendicular to a plane in which the flat exterior section 14 of the primary head generally lies. Each of the primary fins has a generally circular hole 70,72 therethrough. Each of the holes 70,72 of the primary fins is adapted for extending a finger or thumb of a user when the user grasps the primary head with a hand 74 of the user as illustrated in FIG. 10. Ideally, each of the holes of the primary fins has centers lying along a line extending generally perpendicular to the longitudinal axis of the interior section of the primary head. Each of the primary fins has a length defined in a direction from the intermediate section of the primary head towards the connector. Preferably, the lengths of the primary fins are about equal to one another. In an ideal illustrative embodiment, the length of each of the primary fins is about 2 inches to providing an optimal length for grasping by the hand of the user.

As illustrated in FIG. 11, this preferred embodiment, may also include the flexible hose 64 couplable between the shower outlet tube 22 and the interior section 20. The flexible hose 64 has a pair of opposite ends and a longitudinal axis extending between the ends of the flexible hose. A first of the ends of the flexible hose is couplable to the connector 30 and a second of the ends of the flexible hose is couplable to the shower outlet tube 22. The flexible hose 64 has a pair of generally planar secondary fins 76,78 each having a generally triangular outer perimeter. The secondary fins 76,78 of the flexible hose are outwardly extended from the flexible hose adjacent the second end of the flexible hose. The secondary fins of the flexible hose preferably generally lie in a common plane with one another generally parallel to the longitudinal axis of the flexible hose.

Each of the secondary fins 76,78 has a generally circular hole 80,82 therethrough. Each of the holes 80,82 of the secondary fins is adapted for extending a finger or thumb of a user to when the user grasps the flexible hose with a hand of the user to aid in the directing of the primary head with the flexible hose by the user. Ideally, each of the holes of the secondary fins have centers lying along a line extending generally perpendicular to the longitudinal axis of the flexible hose. The length of each of the primary fins is about 2 inches to provide an optimal length for grasping by the hand of the user.

As described hereinabove, the present system consists of a detachable and flexible showerhead replacement having an easy-to-grip handle with finger grips and an adjustable water volume dial. This system also features a brush attachment which combines the functions of a water and scalp massage. The user simply turns on the water, and the brush bristles quickly and effectively cleanse and massage the body and scalp.

The system brings the conveniences of present day showering to a person's fingertips and could be marketed to both consumers and commercial locations, such as hotels, motels, and beauty salons. The apparatus measures approximately 2 to 2½ feet long and is 3 inches in diameter. It is available in a wide variety of colors, and styles to coordinate with any bathroom decor.

The appealing features of the apparatus would be its novelty, convenience, practicality, durability, therapeutic qualities, and ease of use. This personal care unit provides a person with a relaxing shower massage for the scalp and body. The massage unit of the apparatus massages sore muscles and relieves tension. During use, the apparatus could improve circulation.

In addition, the amount of water usage is easily adjusted with a dial, which conserves water and energy and saves consumers money.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A brush and water spray system for spraying and brushing a person in the shower comprising:

a primary head having a flat exterior section with apertures therethrough for dispensing water, a tubular interior section in a cylindrical configuration adapted to be coupled to a shower outlet tube for receiving water to be dispensed and a generally hemispherical intermediate section with a housing therewithin;

a connector at the interiormost end of the interior section including a hemispherical male component coupled to the interior face and a rotatable cylinder with a hemispherical female surface adapted to receive the male component and with internal threads couplable to the shower outlet tube;

a pair of primary straps having exterior ends attached to the intermediate section of the primary head, a pair of secondary straps having interior ends attached to the interior section of the primary head with sleeves between the primary and secondary straps to vary the axial spacing between the exterior section and the interior section such that fingers of a user may be inserted between the straps and the interior section to control the direction of the primary head; and a plurality of adapters in a circular configuration with circumferential fingers for the selective removable coupling of the adapters with respect to the exterior section of the primary head, each adapter having outwardly extending fingers of a preselected length with apertures between the fingers for the dispensing of water during operation and use.

2. A brush and water spray system comprising, in combination:

a primary head having a flat exterior section with apertures therethrough for dispensing water, a tubular interior section in a cylindrical configuration adapted to be coupled to a shower outlet tube for receiving water to be dispensed and a generally hemispherical intermediate section with a housing therewithin;

a connector at the interiormost end of the inner section couplable to the shower outlet tube;

a plurality of adapters, each adapter being in a circular configuration with circumferential fingers for the selective removable coupling of the adapters with respect to the exterior section of the primary head, each adapter having outwardly extending fingers of a preselected length with apertures between the fingers for the dispensing of water during operation and use; and a pair of primary straps having exterior ends attached to the intermediate section of the primary head, a pair of secondary straps having interior ends attached to the intermediate section of the primary head with sleeves between the primary and secondary straps to vary the axial spacing between the exterior section and the interior section such that fingers of a user may be inserted between the straps and the interior section to control the direction of the primary head.

3. The system as claimed in claim 2 wherein the connector includes a hemispherical male component coupled to the interior face and a rotatable cylinder with a hemispherical female surface adapted to receive the male component and with internal threads couplable to the shower outlet tube.

4. The system of claim 2, wherein the adapter has a diameter, wherein the primary head has a length defined generally perpendicular to the flat exterior section less than the diameter of the adapter.

5. The system as claimed in claim 2 and further including a flexible hose couplable between the shower outlet tube and the interior section.

6. The system as set forth in claim 2 wherein the coupling between the intermediate section and the interior section is rotatable.

7. The system of claim 2, wherein the adapter has a center and an outer circumference, wherein the fingers and apertures are arranged in a plurality of radial rows of alternating fingers and apertures, the radial rows radiating outwards from the center of the adapter towards the outer circumference of the adapter.

8. The system of claim 7, wherein the adapter is mounted to the exterior section of the primary head to permit free rotation of the adapter about the center of the adapter, wherein rotation of the adapter permits coaxial alignment of each aperture with a hole of the exterior section of the primary head.

9. The system of claim 7, wherein the adapter has a diameter greater than about 1 inch.

10. The system of claim 7, wherein the adapter has a diameter of about 3 inches.

11. The system of claim 5, wherein the flexible hose has a pair of opposite ends, and a length defined between the ends of the flexible hose between about 30 inches and about 36 inches.

12. The system of claim 4, wherein the length of the primary head is about 2 inches.

13. A brush and water spray system for spraying and brushing a user in a shower, the brush and water spray system comprising:

a primary head having a flat exterior section with apertures therethrough for dispensing water, a tubular interior section in a cylindrical configuration adapted to be coupled to a shower outlet tube for receiving water to be dispensed and a generally hemispherical intermediate section with a housing therewithin;

a connector at the interiormost end of the interior section including a hemispherical male component coupled to the interior face and a rotatable cylinder with a hemispherical female surface adapted to receive the male component and with internal threads couplable to the shower outlet tube;

a pair of generally rectangular and generally planar primary fins being outwardly extended from the intermediate section of the primary head in a direction extending from the intermediate section towards the interior section of the primary head, the interior section of the primary head being interposed between the primary fins, the primary fins generally lying in a common plane with one another extending generally parallel to a longitudinal axis along the interior section of the primary head generally perpendicular to a plane in which the flat exterior section of the primary head generally lies;

each of the primary fins having a generally circular hole therethrough, each of the holes of the primary fins being adapted for extending a finger of a user when the user grasps the primary head with a hand of the user;

each of the holes of the primary fins having centers lying along a line extending generally perpendicular to the longitudinal axis of the interior section of the primary head; and each of the primary fins having a length defined in a direction from the intermediate section of the primary head towards the connector, wherein the lengths of the primary fins are about equal to one another, wherein said length of each of the primary fins is about 2 inches to providing an optimal length for grasping by the hand of the user.

14. The brush and water spray system of claim 13, wherein the flexible hose has a pair of generally planar secondary fins each having a generally triangular outer perimeter, the secondary fins of the flexible hose being outwardly extended from the flexible hose adjacent the second end of the flexible hose, the secondary fins of the flexible hose generally lying in a common plane with one another generally parallel to the longitudinal axis of the flexible hose, and wherein each of the secondary fins has a generally circular hole therethrough, each of the holes of the secondary fins being adapted for extending a finger of a user when the user grasps the flexible hose with a hand of the user.

15. The brush and water spray system of claim 14, further comprising a flexible hose couplable between the shower outlet tube and the interior section, the flexible hose having a pair of opposite ends and a longitudinal axis extending between the ends of the flexible hose, a first of the ends of the flexible hose being couplable to the connector, a second of the ends of the flexible hose being couplable to the shower outlet tube.

16. The brush and water spray system of claim 14 wherein each of the holes of the secondary fins having centers lying along a line extending generally perpendicular to the longitudinal axis of the flexible hose.

17. The brush and water spray system of claim 16, further comprising a plurality of adapters in a circular configuration with circumferential fingers for the selective removable coupling of the adapters with respect to the exterior section of the primary head, each adapter having outwardly extending fingers of a preselected length with apertures between the fingers for the dispensing of water during operation and use.

* * * * *